US005329084A

United States Patent [19]

Watanabe et al.

[11] Patent Number: 5,329,084

[45] Date of Patent: Jul. 12, 1994

[54] KEYSWITCH ASSEMBLY

[75] Inventors: Makoto Watanabe, Nagoya; Isao Mochizuki, Kaizu, both of Japan

[73] Assignee: Brother Kogyo Kabushiki Kaisha, Nagoya, Japan

[21] Appl. No.: 33,348

[22] Filed: Mar. 18, 1993

[30] Foreign Application Priority Data

Mar. 30, 1992 [JP] Japan ..... 4-026464[U]

[51] Int. Cl.[5] ..... H01H 3/12

[52] U.S. Cl. ..... 200/344

[58] Field of Search ..... 200/344, 517

[56] References Cited

U.S. PATENT DOCUMENTS 4,580,022 4/1986 Oelsch et al. ..... 200/344
4,902,862 2/1990 Oelsch et al. ..... 200/344
5,268,545 12/1993 Bruner ..... 200/344 X
5,278,371 1/1994 Watanabe et al. ..... 200/344

FOREIGN PATENT DOCUMENTS

0134509A3 3/1985 European Pat. Off. .
0295437A3 12/1988 European Pat. Off. .
3616669A1 11/1987 Fed. Rep. of Germany .
2-5236 1/1990 Japan .
2077195A 12/1981 United Kingdom .

*Primary Examiner*—Renee S. Luebke
*Attorney, Agent, or Firm*—Oliff & Berridge

[57] ABSTRACT

The present invention provides a keyswitch assembly having a key restrained from horizontal movement and from free vertical movement so that the key will not be moved by an accidental light touch to the key while providing a satisfactory touch of the key and reliable switching action. Pairs of pins formed at the opposite ends of four support members, four upper guide portions and four lower guide portions cooperate to support a key for vertical movement. The respective inner surfaces of the guide portions are substantially in contact with the respective outer surfaces of the support members, each with a very small clearance therebetween, respectively. A pressure plate, mounted on an elastic switching member, and the support members cooperate to support the key. Thus, the key is restrained from horizontal movement and from free vertical movement.

20 Claims, 3 Drawing Sheets

KEYSWITCH ASSEMBLY

BACKGROUND OF THE INVENTION

1. Field of the Invention

The present invention relates to a keyswitch assembly and, more particularly, to a keyswitch assembly provided with a key restrained from horizontal movement and from free vertical movement, both when depressed and when not depressed. The key is suitable for use on a thin keyboard for portable word processors, personal computers and the like.

2. Description of the Related Art

Known keyswitch assemblies are disclosed in U.S. Pat. Nos. 4,580,022 ('022) and 4,902,862 ('862). These prior art keyswitch assemblies are provided with a large key, such as a space key or a return key, which has a construction capable of preventing the key from tilting when depressed.

The prior art keyswitch assembly proposed in the '022 patent has two pairs of key supports each formed by pivotally joining two support levers provided with pins at their opposite ends in a scissors-like form, a key supported on the key supports and provided with a pushing part, a switching member disposed apart from the center of the key, and a key guide for guiding the key for vertical movement. When the key is depressed, the pins of the support levers slide horizontally along pin guides formed on the back surface of the key and on the upper surface of a base plate, and the pushing part of the key slides vertically along the key guide to push the switching member.

The keyswitch assembly proposed in the '862 patent basically is the same in construction as the keyswitch assembly proposed in the '022 patent and is characterized by the scissors-like key supports designed to facilitate attaching the key thereto.

These prior art keyswitch assemblies are capable of maintaining the large key, such as the space key, in a horizontal position during the vertical movement of the key regardless of the point of application of pressure on the key when the key is depressed.

As is obvious from the drawings of the '022 and '862 patents, the pins formed at the opposite ends of the support levers of the scissors-like key supports are guided for horizontal movement by the pin guides formed on the back surface of the key and on the upper surface of the base plate. However, the keyswitch assemblies have no means for restraining the pins formed at the lower ends of the support levers from movement in a horizontal direction other than the horizontal direction along the pin guides formed on the upper surface of the base plate.

Accordingly, it is highly possible that the scissors-like key supports move needlessly in horizontal directions, both when the key is depressed and when the key is not depressed. When depressing the key, in particular, the needless horizontal movement of the scissors-like key supports spoils the touch of the key and, in the worst case, it is possible that the needless horizontal movement of the scissors-like key supports makes the key unable to operate the switching member.

Both the prior art keyswitch assemblies provide no means to prevent the needless vertical movement of the key when the key is not depressed. Therefore, the key is moved vertically by a light touch to the key, which also spoils the touch of the key.

SUMMARY OF THE INVENTION

The present invention has been designed to solve the foregoing problems in the prior art keyswitch assemblies. It is therefore an object of the present invention to provide a keyswitch assembly capable of surely restraining the key from needless horizontal movement and from free vertical movement while the key is not depressed, of restraining the key from horizontal movement when the key is depressed, of facilitating the operation of the key and of accurately performing a switching operation.

To achieve the above and other objects, the present invention provides a keyswitch assembly comprising: a key having four first guide portions on its back surface; a holding member having four second guide portions respectively corresponding to the first guide portions on its upper surface, and disposed under the key; a key support mechanism connected to the first guide portions of the key and the second guide portions of the holding member, so as to support the key for vertical movement; and, a switching member to be operated for switching action by the key when the key is moved vertically. The keyswitch assembly is characterized in that the first guide portions have, respectively, first guide grooves, the respective directions of extension of the first guide grooves being shifted sequentially through an angle of 90 degrees with respect to the direction of extension of the adjacent first guide groove; and the second guide portions have, respectively, second guide grooves, the respective directions of extension of the second guide grooves being shifted sequentially through an angle of 90 degrees and are opposite to those of extension of the corresponding first guide grooves. The key support mechanism comprises a pressure plate mounted on the switching member and provided with four pivots, and four support members each having a hole for receiving the pivot of the pressure plate so that the same is pivotally supported on the pivot of the pressure plate and provided with pins at the opposite ends thereof. One of the two pins of each support member engages the guide groove of one of the four first guide portions, and the other pin of the same support member engages the guide groove of the second guide portion positioned diagonally opposite to the first guide portion. The inner surfaces of the support members having the pins engaging the guide grooves of the second guide portions are substantially in contact with the inner surfaces of the second guide portions to restrain the key from horizontal movement, and the pressure plate mounted on the switching member and the support members cooperate to restrain the key from free vertical movement.

The pins of the four support members are in engagement with the four first guide portions formed on the back surface of the key and the four second guide portions formed on the upper surface of the holding member to support the key, and the pressure plate is held at the initial position on the switching member by the support members.

Contact between the outer surfaces of the support members and the inner surfaces of the second guide portions restrains the key from horizontal movement, and the cooperative function of the pressure plate and the support members restrains the key from free vertical movement. Accordingly, the key is unable to be moved horizontally and to be moved freely vertically by an accidental touch to the key. When the key held at the initial position is depressed, the pins of the support members slide along the first guide grooves of the first guide portions and the second guide grooves of the second guide portions and the pressure plate is shifted downward to compress the switching member. Upon the compression of the switching member beyond a predetermined degree, the switching member buckles for a switching action.

Since the outer surfaces of the support members are in contact with the inner surfaces of the second guide portions, the key is unable to move horizontally while the same is being depressed. Thus, the switching member can be properly compressed for a reliable switching action by the key.

As is apparent from the foregoing description, in accordance with the present invention, the key is securely restrained from horizontal movement and from free vertical movement while the key is not depressed and the key is restrained from horizontal movement when the key is depressed. Thus, the key of the keyswitch assembly of the present invention has a satisfactory touch and is capable of being accurately operated for a reliable switching action.

DETAILED DESCRIPTION OF PREFERRED EMBODIMENTS

A keyswitch assembly in a preferred embodiment according to the present invention will be described hereinafter with reference to the accompanying drawings. The terms vertical, horizontal, upper, lower, longitudinal, transverse and lateral used herein are employed for purposes of description and are not intended to limit the orientation of the assembly.

Figure 1:
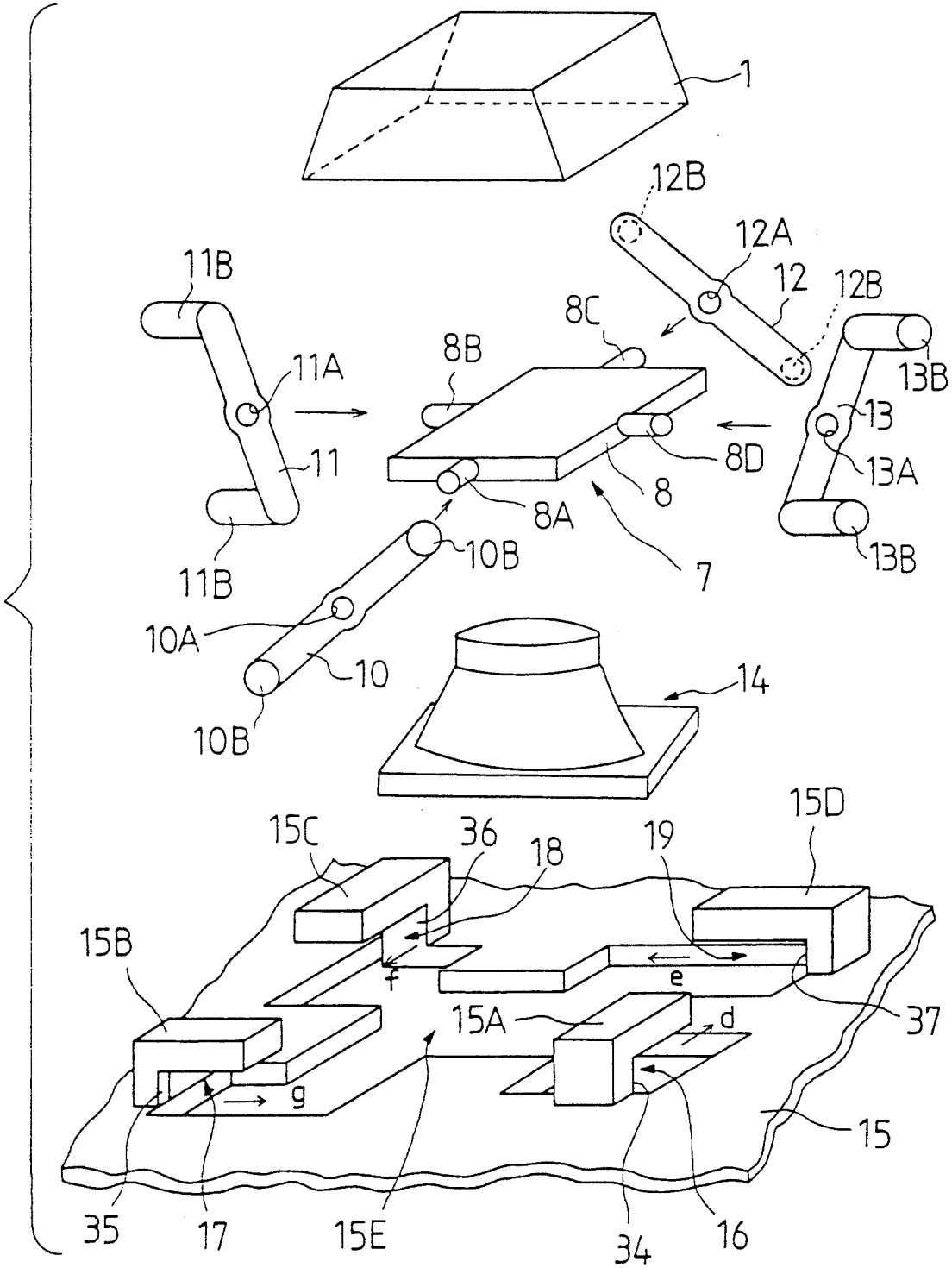
FIG. 1 is an exploded perspective view of a keyswitch assembly in a preferred embodiment according to the present invention.
Figure 2:
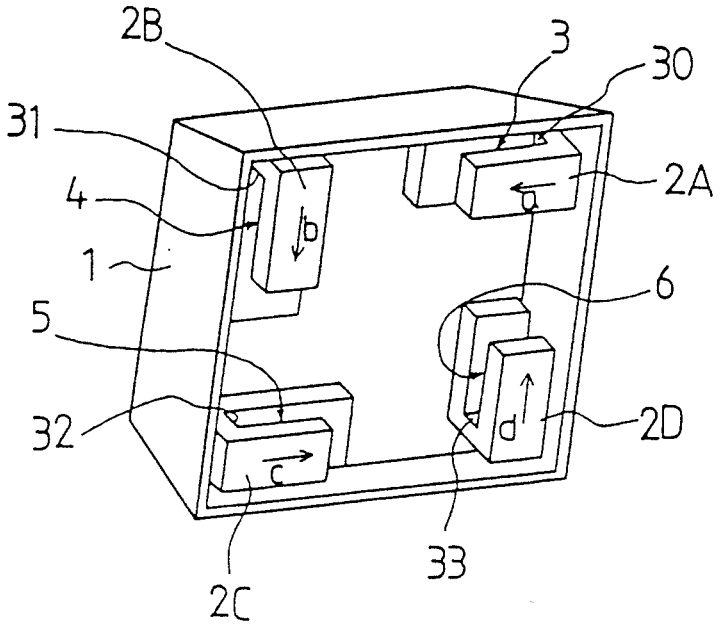
FIG. 2 is a perspective view showing the back surface of a key.

Referring to FIG. 1 showing the keyswitch assembly in an exploded perspective view, a key 1 is formed of a synthetic resin, such as an ABS resin, by molding. A character, such as an alphabetical character or the like, is formed by printing or the like on the upper surface of the key 1. As shown in FIG. 2, the key 1 is provided with four guide portions 2A, 2B, 2C and 2D on the back surface thereof.

As shown in FIG. 2, guide grooves 3, 4, 5 and 6 are formed, respectively, in the guide portions 2A, 2B, 2C and 2D. The guide grooves 3, 4, 5 and 6 are open in the directions of arrows a, b, c and d, and the directions of extension of the guide grooves 3, 4, 5 and 6 are oriented sequentially through an angle of about 90 degrees with respect to the direction of extension of the adjacent guide grooves in a counterclockwise direction as viewed in FIG. 2. The guide grooves 3, 4, 5 and 6 terminate at end walls 30, 31, 32 and 33, respectively which form horizontal stop surfaces.

The key is supported for vertical movement by a support mechanism 7 comprising a pressure plate 8 and the four support members 10, 11, 12 and 13. The pressure plate is preferably a square resin plate provided with pins 8A, 8B, 8C and 8D horizontally projecting respectively from the four sides of the square resin plate.

The support members 10, 11, 12 and 13 are the same in shape. The support members 10, 11, 12 and 13 are provided with holes 10A, 11A, 12A and 13A for receiving the pins 8A, 8B, 8C and 8D of the pressure plate 8 in their middle portions, and with pairs of pins 10B, 11B, 12B and 13B projecting from the outer surfaces thereof at the opposite ends thereof, respectively.

The end walls 30, 31, 32 and 33 of the guide grooves limit the horizontal movement of the upper one of two pins 10B formed at the opposite ends of the support member 10, the upper one of two pins 11B formed at the opposite ends of the support member 11, upper one of two pins 12B formed at the opposite ends of the support member 12 and upper one of two pins 13B formed at the opposite ends of the support member 13, respectively.

A rubber spring 14 formed of elastic rubber in the shape of an inverted cup and internally provided with a movable electrode, not shown, is disposed under the pressure plate 8 so that the pressure plate 8 rests thereon. When compressed by the pressure plate 8, the rubber spring 14 buckles and the movable electrode comes into contact with a fixed electrode formed on a flexible wiring board 24, shown in FIGS. 4 and 5, which will be described later, for a switching action.

The rubber spring 14 is placed in an opening 15E formed in a holding member 15. The holding member 15 has four guide portions 15A, 15B, 15C and 15D so as to correspond to the four guide portions 2A, 2B, 2C and 2D formed on the back surface of the key 1. The guide portions 15A, 15B, 15C and 15D are provided with guide grooves 16, 17, 18 and 19, respectively. The guide grooves 16, 17, 18 and 19 are opened in the directions of arrows d, e, f and g, and the directions of extension of the guide grooves 16, 17, 18 and 19 are oriented sequentially through an angle of 90 degrees with respect to the direction of extension of the adjacent guide groove in a counterclockwise direction as viewed in FIG. 1. The opening 15E is formed in the central portion of the holding member 15 and the guide portions 15A, 15B, 15C and 15D are arranged around the opening 15E. The rubber spring 14 is fitted in the opening 15E for positioning. The guide grooves 16, 17, 18 and 19 terminate at end walls 34, 35, 36 and 37, respectively. The end walls 34, 35, 36 and 37 limit the horizontal movement of the respective lower pins 13B, 10B, 11B and 12B of the support members 13, 10, 11 and 12, respectively.

The upper pin 10B of the support member 10 engages the guide groove 3 of the guide portion 2A, and the lower pin 10B of the same engages the guide groove 17 of the guide portion 15B. The upper pin 11B of the support member 11 engages the guide groove 4 of the guide portion 2B, and the lower pin 11B of the same engages the guide groove 18 of the guide portion 15C.

The upper pin 12B of the support member 12 engages the guide groove 5 of the guide portion 2C, and the lower pin 12B of the same engages the guide groove 19 of the guide portion 15D. The upper pin 13B of the support member 13 engages the guide groove 6 of the guide portion 2D, and the lower pin 13B engages the guide groove 16 of the guide portion 15A.

The pressure plate 8 resting on the rubber spring 14 and the support members 10, 11, 12 and 13 restrain the key 1 cooperatively from free vertical movement so that the key will not be vertically moved by an accidental light touch to the key and will be held securely at the initial position.

Figure 3:
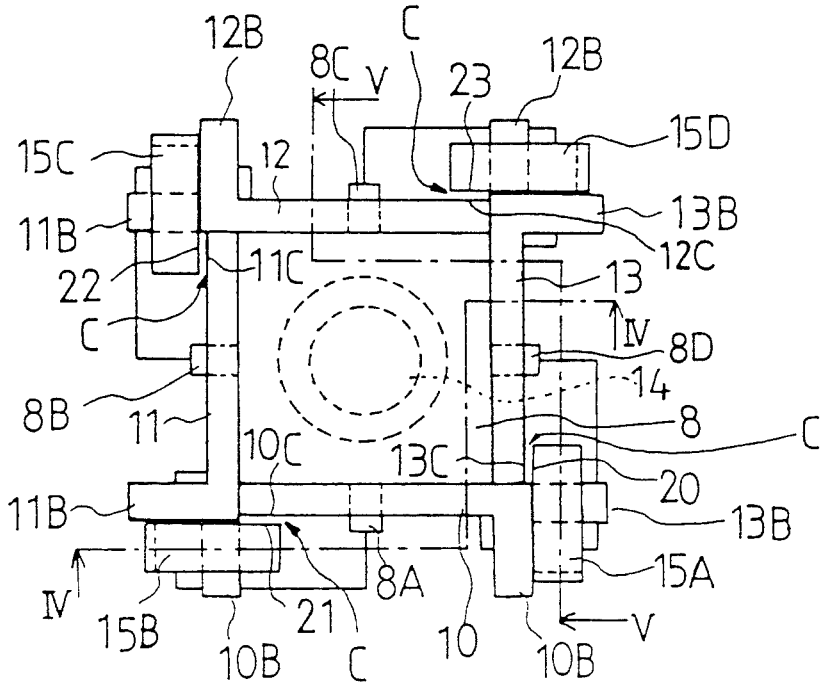
FIG. 3 is a plan view of the keyswitch assembly of FIG. 1, in which the key is omitted.

Referring to FIG. 3 showing the keyswitch assembly in a plan view with the key 1 removed, a very small clearance C on the order of 0.1 mm is formed between the inner surface 20 of the guide portion 15A and the outer surface 13C of the support member 13, from the lower portion of which the lower projection 13B projects to engage the guide groove 16 of the guide portion 15A. Similarly, the same clearances C are formed between the inner surface 21 of the guide portion 15B and the outer surface 10C of the support member 10, between the inner surface 22 of the guide portion 15C and the outer surface 11C of the support member 11 and between the inner surface 23 of the guide portion 15D and the outer surface 12C of the support member 12, respectively.

Thus, the movement of the key 1 in any horizontal direction is limited to a very small distance equal to the very small clearance C because one of the respective inner surfaces 20, 21, 22 and 23 of the guide portions 15A, 15B, 15C and 15D comes into contact with the corresponding one of the outer surfaces 10C, 11C, 12C and 13C of the support members 10, 11, 12 and 13 when the key moves horizontally by the distance equal to the very small clearance C. Thus, the key 1 is restrained substantially from horizontal movement. Accordingly, the key 1 will not be horizontally moved by an accidental light touch to the key 1 while the same is held at the initial position and will not move horizontally when depressed.

Figure 4:
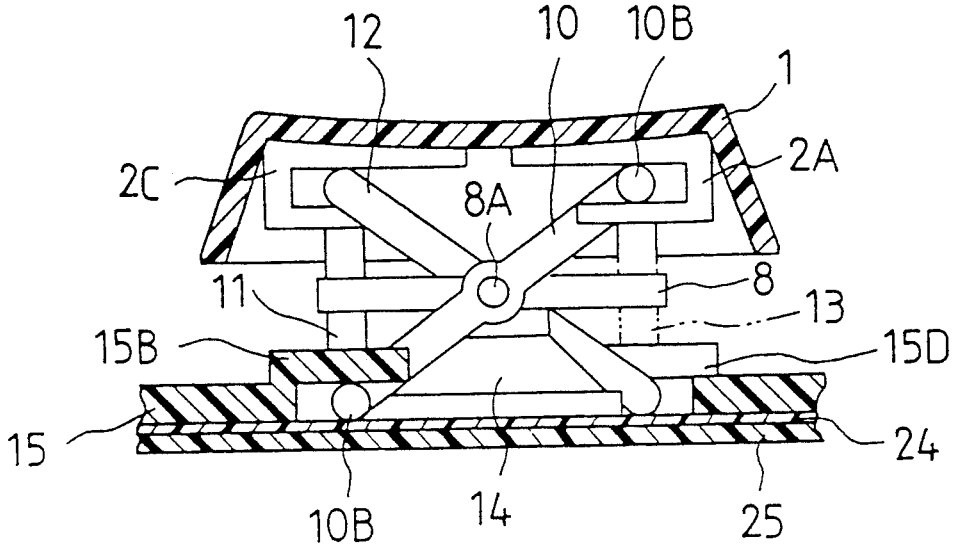
FIG. 4 is a partial sectional side view of the keyswitch assembly of FIG. 1 in an unoperated state taken along line IV—IV in FIG. 3 with the key included.
Figure 5:
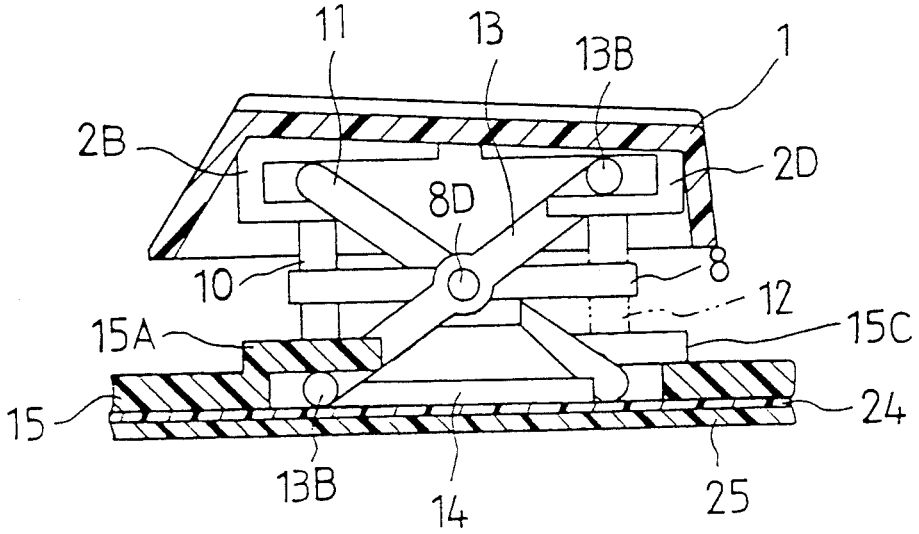
FIG. 5 is a partial sectional side view of the keyswitch assembly of FIG. 1 in an unoperated state taken along line V—V in FIG. 3 with the key included.

Referring now to FIGS. 4 and 5, the flexible wiring board 24 is placed under the holding member 15. The fixed electrode, not shown, is formed opposite to the movable electrode provided within the rubber spring 14 on the flexible wiring board 24. When depressed by the key 1, the pressure plate 8 compresses the rubber spring 14, and then the rubber spring 14 buckles when compressed beyond a predetermined degree, so that the movable electrode comes into contact with the fixed electrode for a switching action. The rubber spring 14 is fitted in the opening 15E, shown in FIG. 1, of the holding plate 15 so as to be seated on the flexible wiring board 24.

A switch support plate 25 underlies the flexible wiring board 24 to support the flexible wiring board 24, the holding member 15 and the rubber spring 14 thereon.

The operation of the keyswitch assembly thus constructed will be described hereinafter. When the keyswitch assembly is in an unoperated state, the key 1 is restrained from free vertical movement by the cooperative action of the pressure plate 8 mounted on the elastic rubber spring 14 and the support members 10, 11, 12 and 13. The key 1 is restrained substantially from horizontal movement because only the very small clearances C are formed between the respective inner surfaces 20, 21, 22 and 23 of the guide portions 15A, 15B, 15C and 15D, and the corresponding outer surfaces 10C, 11C, 12C and 13C of the support members 10, 11, 12 and 13, respectively.

When the key 1 is depressed, the upper pins 10B, 11B, 12B and 13B of the support members 10, 11, 12 and 13 slide along the guide grooves 3, 4, 5 and 6 of the guide portions 2A, 2B, 2C and 2D toward the end walls 30, 31, 32 and 33, respectively, and, at the same time, the lower pins 10B, 11B, 12B and 13B slides along the guide grooves 16, 17, 18 and 19 of the guide portions 15A, 15B, 15C and 15D toward the end walls 34, 35, 36 and 37, respectively.

If pressure is applied obliquely to the upper surface of the key 1, the key tends to move horizontally. However, the horizontal movement of the key 1 is limited to the short distance corresponding to the very small clearance C, because one of the outer surfaces 10C, 11C, 12C and 13C of the support members 10, 11, 12 and 13 comes into contact with the corresponding one of the inner surfaces 20, 21, 22 and 23 of the guide portions 15A, 15B, 15C and 15D. Thus, the key 1 is substantially unable to move horizontally which ensures a satisfactory touch of the key 1.

As the pins 10B, 11B, 12B and 13B slide in the guide grooves 3, 4, 5 and 6 of the guide portions 2A, 2B, 2C and 2D and in the guide grooves 16, 17, 18 and 19 of the guide portions 15A, 15B, 15C and 15D, the pressure plate 8 moves downward to compress the rubber spring 14 gradually. Upon the compression of the rubber spring 14 to a predetermined degree, the rubber spring 14 buckles suddenly and, consequently, the movable electrode of the rubber spring 14 comes into contact with the fixed electrode of the flexible wiring board 24 for switching action.

As the key 1 is depressed further, the pins 10B of the support members 10 move in the guide grooves 3 and 17, respectively, the pins 11B of the support member 11 move in the guide grooves 4 and 18, respectively, the pins 12B move in the guide grooves 5 and 19, respectively, and the pins 13B of the support member 13 move in the guide grooves 6 and 16, respectively. Finally, the pins 10B are pressed against the end walls 30 and 35, the pins 11B are pressed against the end walls 31 and 36, the pins 12B are pressed against the end walls 32 and 37, and the pins 13B are pressed against by the end walls 33 and 34, respectively, at the end of stroke of the key 1. In this state where the key 1 is fully depressed, the key 1 is unable to move horizontally.

When the key 1 is released after being fully depressed, the pressure plate 8 is raised by the resilience of the rubber spring 14, moving the pins 10B of the support member 10, the pins 11B of the support member 11, the pins 12B of the support member 12 and the pins 13B of the support member 13 in the reverse directions in the corresponding guide grooves 3 and 17, the guide grooves 4 and 18, the guide grooves 5 and 19, and the guide grooves 6 and 16, respectively. Upon the return of the key 1 to the initial position to complete one keystroke, the pins 10B, 11B, 12B and 13B arrive at their initial positions.

As is apparent from the foregoing description, since the key 1 is supported for vertical movement by the four support members 10, 11, 12 and 13 respectively provided with the pins 10B, 11B, 12B and 13B slidably engaging the guide portions 2A, 2B, 2C and 2D and guide portions 15A, 15B, 15C and 15D with the very small clearances C between the respective inner surfaces 20, 21, 22 and 23 of the guide portions 15A, 15B, 15C and 15D, and the respective outer surfaces 10C, 11C, 12C and 13C of the corresponding support members 10, 11, 12 and 13, respectively, the key 1 is securely restrained from horizontal movement in both the unoperated state and the operated state.

Since the pins 10B, 11B, 12B and 13B are pressed against the end walls 30 and 35, the end walls 31 and 36, the end walls 32 and 37, and the end walls 33 and 34, respectively, at the end of stroke of the key 1, the key 1 never moves horizontally when it is fully depressed. Since the pressure plate 8 pivotally supporting the support members 10, 11, 12 and 13 rests on the rubber spring 14 to support the key 1 by the cooperative action of the pressure plate 8 and the support members 10, 11, 12 and 13, the key 1 is held at the initial position by the resilience of the rubber spring 14 and securely restrained from free vertical movement.

Since the key 1 is thus restrained from horizontal movement and from free vertical movement, the key 1 will not be moved by an accidental light touch to the key while the keyswitch assembly is in the unoperated state, and the key 1 will not needlessly move horizontally when the key 1 is depressed. Accordingly, satisfactory touch of the key I and reliable switching action can be secured.

When the key 1 is depressed, the pressure plate 8 remains in a horizontal position to compress the rubber spring 14 truly vertically, and the key 1 can be held in a horizontal position without using any additional means for preventing the tilt of the key 1 to compress the rubber spring 14 truly vertically for reliable switching action regardless of the point of application of pressure on the key 1.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A keyswitch assembly comprising:

a key having four upper guide groove portions, each upper guide groove portion comprising horizontal stop means for limiting horizontal longitudinal movement and horizontal lateral movement of said key;

a holding member comprising a plate with a central opening therein and four lower guide portions corresponding to said upper guide portions, each lower guide groove portion comprising horizontal stop means for limiting horizontal longitudinal movement and horizontal lateral movement of said key;

support means for supporting said key in a first rest position and a second depressed position, comprising four elongated support members, each with an upper end, a lower end and an outer side surface, and a vertical stop means for resisting vertical movement of said key, each of said upper ends being slidingly engaged with one of said upper guide groove portions and each of said lower ends being slidingly engaged with one of said lower guide groove portions; and switching means for causing switching action comprising an electrical contact disposed over said opening of said holding member and under said support means, wherein said support means compresses said switching means to cause said electrical contact to make an electrical connection in said second depressed position.

2. The keyswitch assembly of claim 1, wherein said horizontal stop means of said each said upper guide groove portion comprises a flange defining an elongated open ended groove, said flange having an inner side surface and extending in a direction approximately 90° from an adjacent flange, wherein each said outer side surface of said support members is closely adjacent to each said inner side surface of said flanges, respectively, to thereby limit the horizontal longitudinal and lateral movement of said key.

3. The keyswitch assembly of claim 2, wherein said flanges are oriented in a counterclockwise direction and define a square outline.

4. The keyswitch assembly of claim 1, wherein said horizontal stop means of said each said lower guide groove portion comprises a flange defining an elongated open ended groove, said flange having an inner side surface and extending in a direction approximately 90° from an adjacent flange, wherein each said outer side surface of said support members is closely adjacent to each said inner side surface of said flanges, respectively, to thereby limit the horizontal longitudinal and lateral movement of said key.

5. The keyswitch assembly of claim 4, wherein said flanges are oriented in a counterclockwise direction and define a square outline.

6. The keyswitch assembly of claim 1, wherein each end of said elongated support members has an end pin extending outwardly therefrom, each said end pin slidingly engaged with one of said upper guide groove portions and said lower guide groove portions.

7. The keyswitch assembly of claim 1, wherein said vertical stop means comprises a polygonal pressure plate, each of said support members being pivotally secured to a different side of said pressure plate.

8. The keyswitch assembly of claim 7, wherein said pressure plate is a square.

9. The keyswitch assembly of claim 7, wherein said pressure plate has four pivot pins, each pin extending outwardly from a different side thereof and engaged with one of said support members.

10. The keyswitch assembly of claim 7, wherein said switching means further comprises a resilient spring with an upper surface and a lower surface, said electrical contact being secured to said lower surface and said pressure plate contacting said upper surface.

11. The keyswitch assembly of claim 1, wherein said switching means further comprises a resilient spring with said electrical contact secured thereto.

12. A keyswitch assembly comprising:

a key having four upper guide groove portions;

a holding member comprising a plate with a central opening therein and four lower guide portions corresponding to said upper guide groove portions;

a support supporting said key in a first rest position and a second depressed position, comprising four elongated support members with upper and lower ends and a pressure plate, each of said four support members being pivotally secured to a different side of said pressure plate, wherein each of said upper ends is slidingly engaged with one of said upper guide groove portions and each of said lower ends is slidingly engaged with one of said lower guide groove portions; and a switch causing switching action comprising an electrical contact disposed over said opening of said holding member and under said support, wherein said pressure plate contacts said switch in said first rest position and bears on and compresses said switch in said second depressed position to cause said electrical contact to make an electrical connection.

13. The keyswitch assembly of claim 12, wherein said pressure plate is a square.

14. The keyswitch assembly of claim 12, wherein said pressure plate has four pivot pins, each pin extending outwardly from a different side thereof and engaged with one of said support members.

15. The keyswitch assembly of claim 12, wherein said switch further comprises a resilient spring with an upper surface and a lower surface, said electrical contact being secured to said lower surface and said pressure plate contacting said upper surface.

16. The keyswitch assembly of claim 12, wherein said switch further comprises a resilient spring with said electrical contact secured thereto.

17. The keyswitch assembly of claim 12, wherein each upper guide groove portion comprises a horizontal stop limiting horizontal longitudinal movement and horizontal lateral movement of said key; and each lower guide groove portion comprising a horizontal stop limiting horizontal longitudinal movement and horizontal lateral movement of said key.

18. The keyswitch assembly of claim 17, wherein said horizontal stop of said each said upper guide groove portion comprises a flange defining an elongated open ended groove, said flange having an inner side surface and extending in a direction approximately 90° from an adjacent flange, wherein each said elongated support member is closely adjacent to each said inner side surface of said flanges, respectively, to thereby limit the horizontal longitudinal and lateral movement of said key; and said horizontal stop of said each said lower guide groove portion comprises a flange defining an elongated open ended groove, said flange having an inner side surface and extending in a direction approximately 90° from an adjacent flange, wherein each said elongated support member is closely adjacent to each said inner side surface of said flanges, respectively, to thereby limit the horizontal longitudinal and lateral movement of said key.

19. The keyswitch assembly of claim 18, wherein said flanges are oriented in a counterclockwise direction and define a square outline.

20. A keyswitch assembly comprising:

a key with a front and back surface, said back surface having four upper guide groove portions, each upper guide groove portion comprising a flange spaced from said back surface and defining a groove having an open end and a closed end, each said flange having an inner side surface and extending in a direction approximately 90° from an adjacent flange;

a holding member comprising a plate with a central opening therein and four lower guide portions corresponding to said upper guide portions, each lower guide groove portion comprising a flange spaced from said plate and defining a groove having an open end and a closed end, each said flange having a inner side surface and extending in a direction approximately 90° from an adjacent flange;

a support mechanism for supporting said key in a first rest position and a second depressed position, comprising four elongated support members, each support member having a body with a hole therein, an outer side surface, an upper end and a lower end, each end having an end pin extending outwardly therefrom, and a quadrilateral pressure plate with outwardly extending pivot pins on each side thereof, wherein each of said pivot pins on said quadrilateral pressure plate is pivotally secured in said holes of said elongated support members, and wherein each upper end is slidingly engaged with an upper guide groove portion, each lower end is slidingly engaged with a lower guide groove portion, and each outer side surface is closely adjacent to each inner side surface of each respective flange; and a switching member comprising a resilient spring with an electrical contact disposed in said opening of said holding member and below said quadrilateral pressure plate, wherein said quadrilateral pressure plate rests on said resilient spring in said first rest position and compresses said switching member to cause said electrical contact to make an electrical connection in said second depressed position and wherein each of upper ends and said lower ends contacts said closed end of each respective groove in said second depressed position.

* * * * *